US005898970A

United States Patent [19]

Straiton

[11] Patent Number: 5,898,970

[45] Date of Patent: May 4, 1999

[54] GROUT AND HARD SURFACE CLEANING APPARATUS

[76] Inventor: John H. Straiton, 43 River Falls Dr., Cocoa Beach, Fla. 32931

[21] Appl. No.: 08/949,732

[22] Filed: Oct. 14, 1997

Related U.S. Application Data

[63] Continuation of application No. 08/546,690, Oct. 23, 1995, abandoned.

[51] Int. Cl.[6] ..... A47L 7/00

[52] U.S. Cl. ..... 15/321; 15/322; 15/375

[58] Field of Search ..... 15/320, 321, 322, 15/339, 375

[56] References Cited

U.S. PATENT DOCUMENTS

| | | | |
|---|---|---|---|
| 2,243,935 | 6/1941 | Williamson | 15/375 X |
| 3,142,857 | 8/1964 | Fresard et al. | 15/327.7 |
| 3,562,846 | 2/1971 | Creamer et al. | 15/353 |
| 4,879,784 | 11/1989 | Shero . | |
| 4,976,995 | 12/1990 | Graye . | |
| 4,984,328 | 1/1991 | Berfield . | |
| 5,125,126 | 6/1992 | Bonnant . | |
| 5,157,805 | 10/1992 | Pinter . | |
| 5,180,439 | 1/1993 | Allison . | |
| 5,343,591 | 9/1994 | Clark . | |

FOREIGN PATENT DOCUMENTS

| | | | |
|---|---|---|---|
| 584806 | 10/1959 | Canada | 15/321 |
| 2704308 | 8/1978 | Germany . | |
| 744466 | 2/1956 | United Kingdom | 15/345 |
| 892658 | 3/1962 | United Kingdom . | |

*Primary Examiner*—Chris K. Moore
*Attorney, Agent, or Firm*—Edward M. Livingston, Esq.

[57] ABSTRACT

A grout- and hard-surface cleaner has a water-blast nozzle (5) positioned on a cleaning enclosure (1) to direct a high-pressure and low-volume jet stream of water (36, 37) and optional cleaning material at an attitude onto a surface (4) being cleaned. Resilient and preferably rubberlike surfaces (14) are provided on bottom portions (2) of walls of the cleaning enclosure to facilitate sliding-seal contact with the cleaning enclosure and to provide sliding ease of movement with water and optional cleaning fluid to provide lubricity between the surface being cleaned and the bottom edges of the cleaning enclosure. A wet-vacuum suction tube (12) positioned on a top suction portion (3) of the cleaning enclosure provides low-pressure and high-volume suction pressure that is that provides a level of suction for sliding-seal contact of the cleaning enclosure against the surface being cleaned. An adjustable air control valve (21, 26) in the wall of the cleaning enclosure directly communicates open interior volume of the cleaning enclosure with the outside ambient air to obtain an optimum balance between suction force and water-blast force. Appropriate handling and control means are also provided.

41 Claims, 2 Drawing Sheets

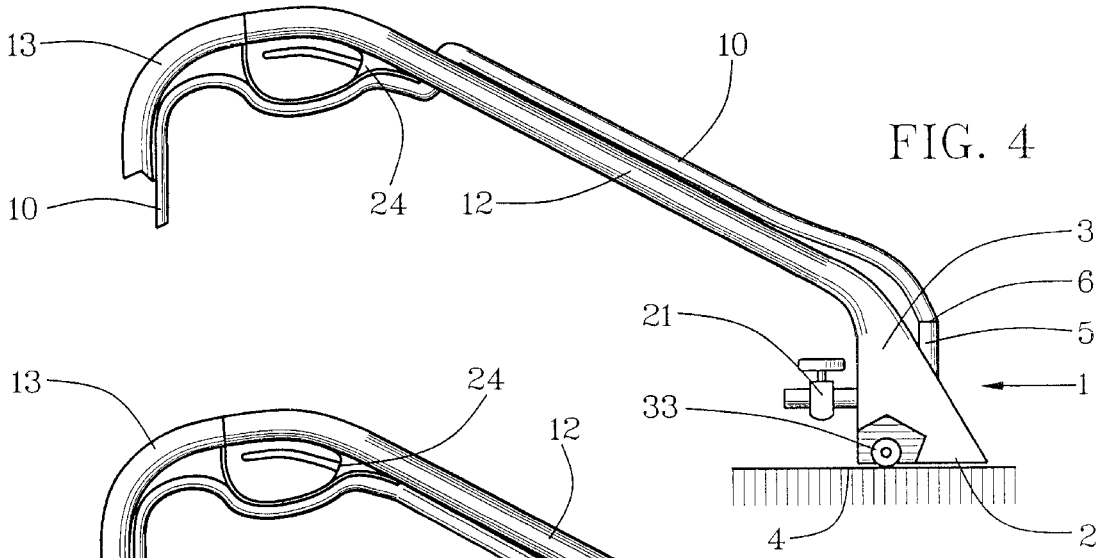
FIG. 4
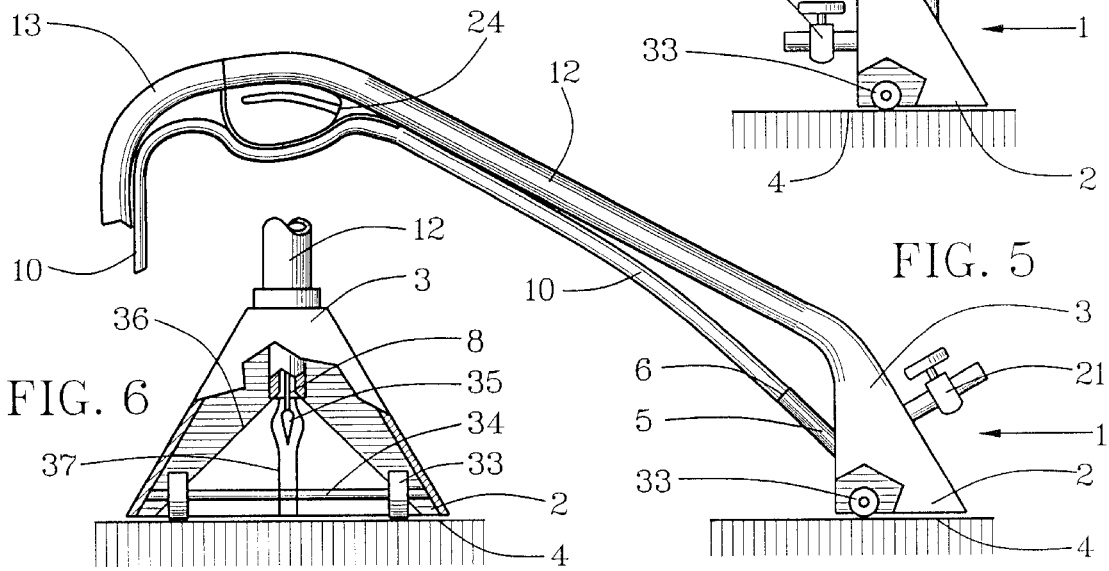
FIG. 5
FIG. 6
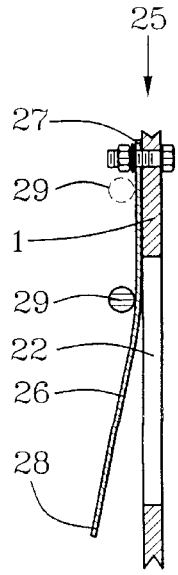
FIG. 7
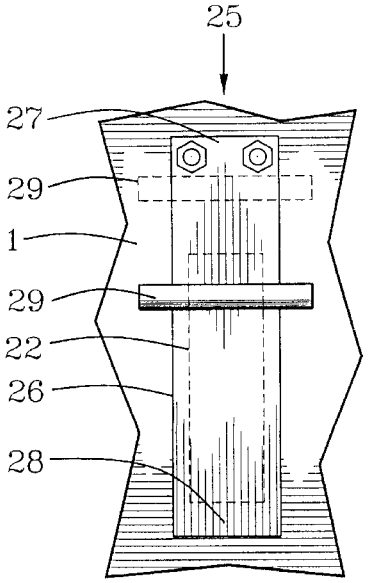
FIG. 8
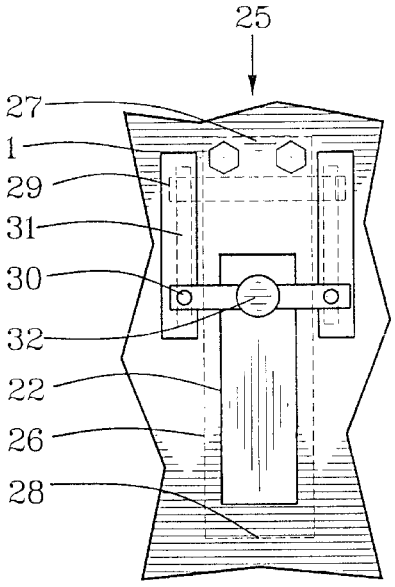
FIG. 9

GROUT AND HARD SURFACE CLEANING APPARATUS

CROSS-REFERENCE TO RELATED APPLICATION

This is a continuation of application Ser. No. 08/546,690, filed Oct. 23, 1995, now abandoned.

BACKGROUND OF THE INVENTION

This invention relates to apparatuses for cleaning grout and other hard surfaces. In particular, it is a high-pressure water-jet cleaner having wet-vacuum waste removal with a high-volume negative-pressure suction of wet waste from a vacuum housing and a low-volume positive-pressure of water from a water-jet nozzle directed into the vacuum housing that has resilient edges which the high-volume negative-pressure suction of wet waste maintains in sliding-seal contact with surfaces being cleaned by water jetted under high pressure with low volume from the water-jet nozzle.

Various machines have been devised for cleaning carpet and other surfaces. None, however, provide the effectiveness and convenience for cleaning tile grout and other hard surfaces taught by this invention.

Examples of different devices are described in the following patent documents. U.S. Pat. No. 5,343,591, issued to Clark on Sep. 6, 1994, teaches a rotary fibrous pad on a handle which contains reservoirs of cleaning fluids and rinsing fluids that are directed under low pressure to and from the fibrous pad. U.S. Pat. No. 5,180,439, issued to Allison on Jan. 19, 1993, teaches a carpet-cleaning wand having containers for holding low-pressure cleaning solution and rinsing solution mounted on it. U.S. Pat. No. 5,157,805, issued to Pinter on Oct. 27, 1992, teaches a spray nozzle directed against a slanted back wall of an elongate vacuum head from which sprayed and variously foamed cleaner are removed by suction into the elongate vacuum head during cleaning strokes. U.S. Pat. No. 5,125,126, issued to Bonnant on Jun. 30, 1992, teaches wide-area jetting of cleaning fluid into a truncate-coned cleaning chamber which is spaced apart inside of a truncate-coned vacuum chamber to form a circumferential channel through which the cleaning fluid is vacuumed from around the truncate-coned cleaning chamber. U.S. Pat. No. 4,984,328, issued to Berfield on Jan. 15, 1991, discloses a drip-cleaning attachment for use in association with a vacuum cleaner for carpets. U.S. Pat. No. 4,976,005, issued to Graye on Dec. 11, 1990, teaches a fluid-medium rug-cleaning vacuum cleaner that is limited to low-pressure injection of cleaning fluid from a nozzle having momentum-drag suction of air to compensate for over-suction of the cleaning fluid through a vacuum-cleaner hood. British Patent Number 892,658, issued on Mar. 28, 1962, teaches a broad-area mouth-piece which covers correspondingly broad-area nozzle-spraying of cleaning fluid which is vacuum-suctioned to a separator of the cleaning fluid from air entering under edges of the mouth-piece.

SUMMARY OF THE INVENTION

In light of product deficiencies that have existed and that continue to exist for cleaning hard surfaces, objectives of this invention are to provide a grout- and hard-surface cleaning apparatus which:

- Directs water-blast directly onto hard surfaces with sufficient jet pressure of the water-blast and optionally cleaning fluids to remove any foreign material that is adhered to the hard surfaces;
- Has a cleaning enclosure with bottom edges of walls of the cleaning enclosure having sliding-seal contact with hard surfaces to prevent escape of water, cleaning fluids and foreign material or dirt from the cleaning enclosure;
- Wet-vacuums water, cleaning fluids, foreign material and dirt from the cleaning enclosure with sufficient pressure and rate of vacuum-suction flow to maintain sliding-seal contact of the bottom edges of the walls of the cleaning enclosure with hard surfaces being cleaned;
- Has resilient surfaces on the bottom edges of the walls of the cleaning enclosure to provide effective sealing of uneven hard surfaces and to provide ease of sliding with lubricity of the water and optional cleaning fluid;
- Has an optional air-control valve which assures an optimum level of high-volume suction force at low pressure to provide a constant, easy to move and reliable sliding-seal contact of the cleaning enclosure with surfaces being cleaned; and
- Has a handle with convenient controls and containment of desired components of the grout- and hard-surface cleaner.

This invention accomplishes the above and other objectives with a grout- and hard-surface cleaner having a water-blast nozzle positioned in a cleaning enclosure to direct a high-pressure and low-volume jet stream of water and optional cleaning material at an attitude onto a surface being cleaned. Resilient and preferably rubberlike surfaces are provided on bottom edges of walls of the cleaning enclosure to facilitate sliding-seal contact with the cleaning enclosure and to provide sliding ease of movement with water and optional cleaning fluid to provide lubricity between the surface being cleaned and the bottom edges of the cleaning enclosure. A wet-vacuum suction tube positioned on a suction portion of the cleaning enclosure provides low-pressure and high-volume suction that provides a level of suction for sliding-seal contact of the cleaning enclosure against the surface being cleaned. A adjustable air-control valve in a wall of the cleaning enclosure assures a an optional high-volume suction for fluid removal and ease of movement of the cleaning enclosure on the surface being cleaned. Appropriate handling and control means are provided.

The above and other objects, features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

This invention is described by appended claims in relation to description of a preferred embodiment with reference to the following drawings which are described briefly as follows:

FIG. 4 is a partially cutaway side elevation view of a vacuum section having wheels and a water-blast nozzle with verticality in relationship to an intended surface to be cleaned;

FIG. 5 is a partially cutaway side elevation view of a vacuum section having wheels and a water-blast nozzle with acuteness in relationship to an intended surface to be cleaned;

FIG. 6 is a partially cutaway front elevation view of a cleaning enclosure having wheels and a water-blast nozzle with spray adjustment;

FIG. 7 is a cutaway side view of an optional force valve having automatic operation and variable setting of opening distance and pressure;

FIG. 8 is an inside view of the FIG. 7 illustration; and

FIG. 9 is an outside view of the FIG. 7 illustration.

DESCRIPTION OF PREFERRED EMBODIMENT

Figure 1:
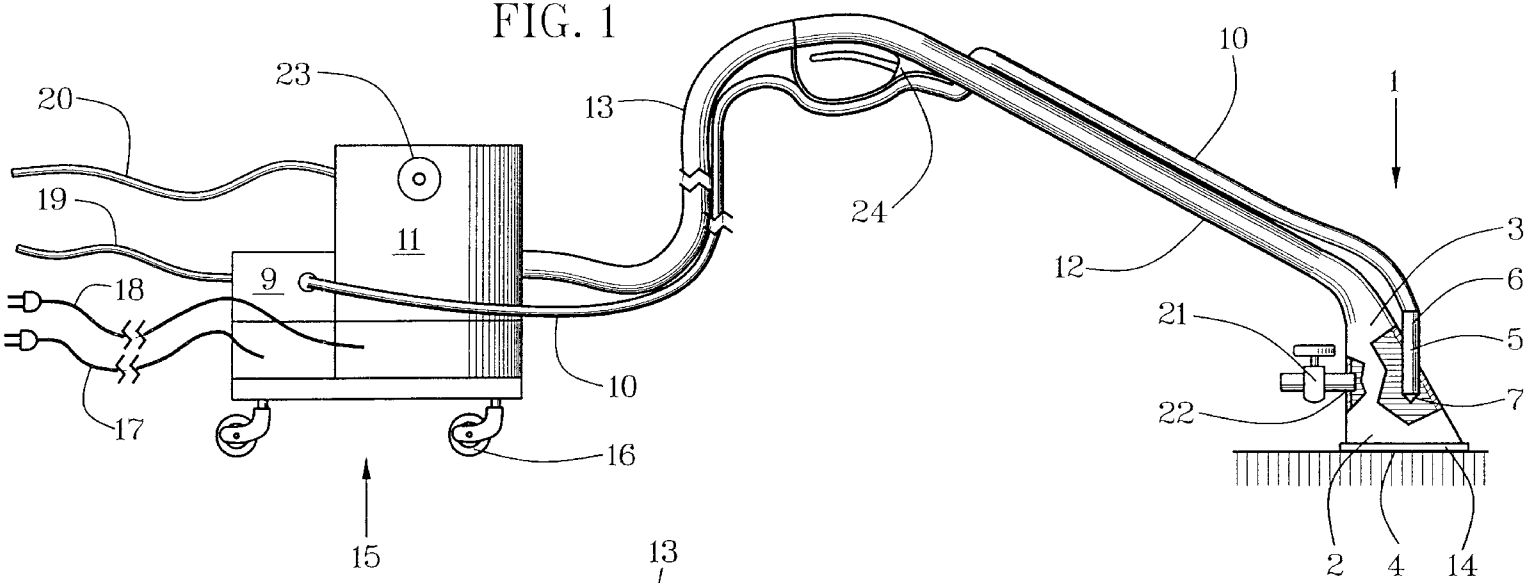
FIG. 1 is a partially cutaway side elevation view of an embodiment having a water-blast nozzle with verticality in relationship to an intended surface to be cleaned.
Figure 2:
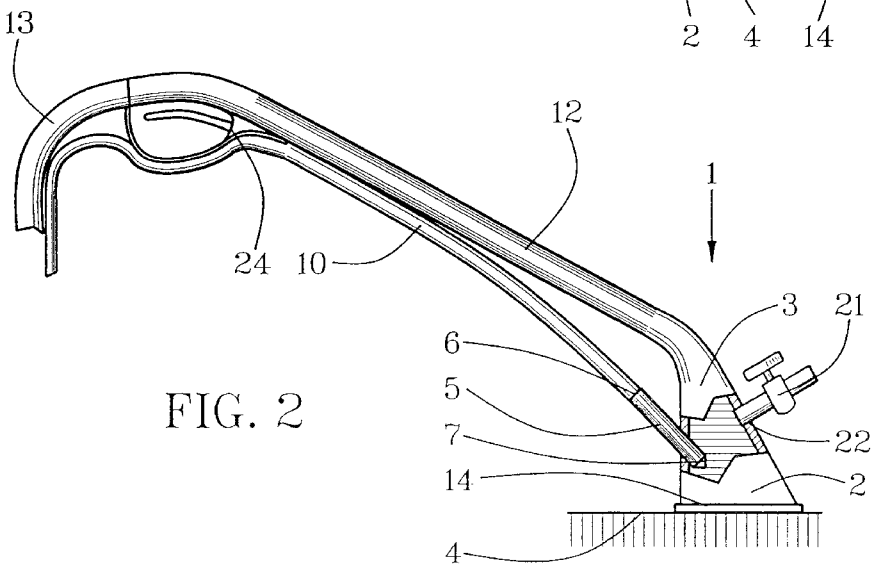
FIG. 2 is a partially cutaway side elevation view of a vacuum section having a water-blast nozzle with desired acuteness in relationship to an intended surface to be cleaned.
Figure 3:
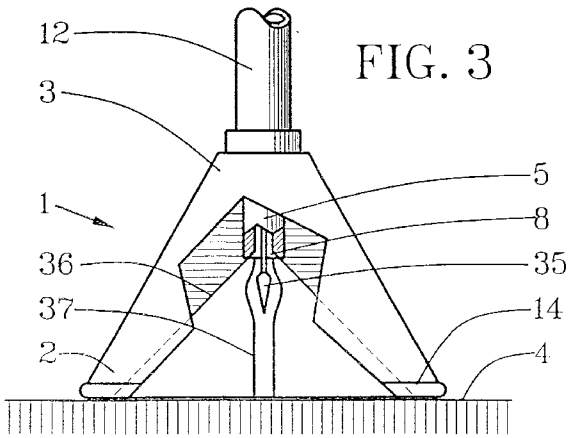
FIG. 3 is a partially cutaway front elevation view of a cleaning enclosure having a water-blast nozzle with spray adjustment.

Reference is made first to FIGS. 1–3. A cleaning enclosure 1 has a perimeter with a surface-covering bottom portion 2 and a designedly smaller vacuum-suction top section 3. An intended surface 4 to be cleaned forms an enclosure surface with the perimeter of the cleaning enclosure 1 being rectangular, circular or arcuate with the vacuum-suction top section 3 being truncate. A water-blast nozzle 5 is attached to the cleaning enclosure 1 with an inlet end 6 of water-blast nozzle 5 positioned outside of the cleaning enclosure 1 and an outlet end 7 of the water-blast nozzle 5 positioned internally in the cleaning enclosure 1.

An outlet orifice 8 in the water-blast nozzle 5 has an axis with an angular relationship and a distance relationship to the intended surface 4. In FIG. 1, the axis of the outlet orifice 8 is vertical in relationship to the intended surface 4. In FIG. 2, the axis of the outlet orifice 8 is acute in relationship to the intended surface 4.

A water-supply source 9 provides water and optional cleaning fluid under high pressure through a high-pressure tube 10 that provides fluid communication from the water-supply source 9 to the inlet end 6 of the water-blast nozzle 5. Pressure of the water is preferably adjustable to between 1,000 and 1,500 pounds-per-square-inch (psi) for effective cleaning of grout and most intended surfaces 4. Normally, water pressure will be 1,200 psi, although low pressures below 1,000 psi and high pressures above 1,500 psi can be used for cleaning a wide range of intended surfaces 4.

A wet vacuum 11 removes water that has been blasted from the water-blast nozzle 5 and dirt that has been removed from the intended surface 4. Blasted water and removed dirt are suctioned first through the vacuum-suction top section 3 of the cleaning enclosure 1, then through a preferably rigid vacuum tube 12 and finally through a preferably flexible vacuum tube 13 to the wet vacuum 11.

A suction of the cleaning enclosure 1 to the intended surface is provided by a greater absolute vacuum-pressure per given surface area of the wet-vacuum 11 than positive water pressure of high-pressure water emerging from the outlet orifice 8 of the water-blast nozzle 5. The greater absolute vacuum-pressure than positive water pressure results from higher crosssectional area of vacuum tubes 12 and 13 with suction pressure of the wet vacuum 11 than the cross-sectional area of the outlet orifice 8 of the water-blast nozzle 5 with the water pressure of the water-supply source 9.

The greater absolute vacuum pressure per given area provided by the wet vacuum 11 suctions the bottom portion 2 of the cleaning enclosure 1 into contact with the intended surface 4. A surface seal 14 on a bottom edge of the bottom portion 2 of the cleaning enclosure 1 has sealing capacity. In particular, the surface seal 14 has sliding-seal contact between the cleaning enclosure 1 and an intended surface 4, either or both of which are wet with water from the water-blast nozzle 5. The surface seal 14 can be a rounded rubber molding or other type of resilient seal or sealing material.

The wet vacuum 11 and the water-supply source 9 are preferably a single cleaning-support unit 15 that is mobile on wheels such as caster wheels 16 or on swivel wheels in combination with non-swivel wheels, such that the single cleaning-support unit 15 can be pulled by an operator to follow wherever desired on the intended surface 4 when in use. Electrical current can be supplied through a water-pump line 17 to the water-supply source 9 and through vacuum-pump line 18 to the wet vacuum 11.

Water is supplied to the water-supply source 9 through a low-pressure water source 19 such as a conventional faucet or water pipe. Dirty water can be pumped from the wet vacuum tank 11 through a drain hose 20 after solids and particles have been separated from the water in the wet vacuum 11.

Desired balance of vacuum in the cleaning enclosure 1 can be provided by vacuum control means. A preferred means for maintaining vacuum pressure is a hand-operative air control valve 21 in an orifice 22. Decrease of opening area of the hand-operative valve increases vacuum pressure tightness of sealing with the surface seal 14. Conversely, increase of opening area of the hand-operative air control valve 21 decreases vacuum pressure and subsequent tightness of sealing with the surface seal 14. The vacuum control orifice 22 can be in an appropriate portion of the cleaning enclosure that is not occupied by the water-blast nozzle 5 as shown in FIGS. 1–2 and 4–5.

In addition to and together with the force valve 21 another means for maintaining absolute vacuum pressure per given area in excess of positive water pressure for desired suction force is variation of either or both a vacuum-pressure control valve 23 at the wet vacuum 11 and a positive water pressure valve 24 in the high-pressure tube 10.

An optional means in place of the force valve 21 for maintaining vacuum pressure is use of an automatic vacuum-pressure-control valve such as a reed valve 25 in an appropriate force-control orifice 22 as illustrated in FIGS. 7–9. With either a hand-operative air control valve 21 or an automatic vacuum-pressure-control valve such as reed valve 25, suction force is maintained in desired relationship to vacuum-force and pressure-force by variation of rate of inflow of air into the cleaning enclosure 1 through the force-control orifice 22.

Automatic opening distance and opening pressure of a reed 26 having a fixed end 27 and an opening end 28 can be varied by sliding a moveable restrainer 29 that is in sliding contact with an opening side of the reed 26. Sliding the moveable restrainer 29 in direction towards the fixed end 27 decreases automatic opening pressure and increases automatic opening distance for greater inflow of air through the force-control orifice 22. Sliding the moveable restrainer in an opposite direction towards the opening end 28 increases opening pressure and decreases opening distance for less inflow of air through the force-control orifice 22.

Sliding action of the moveable restrainer 29 can be achieved from outside of the cleaning enclosure 1 by extension of actuation pins 30 through actuation slots 31 to a cross-member handle 32 at an outside of the cleaning enclosure 1. Other means such as an eccentric cam with an outside knob also are foreseeable for controlling the automatic opening distance and pressure of the reed 26.

As illustrated in FIGS. 4–6, cleaner wheels 33 having axles 34 attached to walls of the cleaning enclosure 1 can be provided to maintain a distance between the cleaning enclosure 1 and the intended surface 4 as well as to facilitate sliding motion during operation. The cleaner can be used with or without the air-control valve 21 or the cleaner wheels 33.

Depicted in FIGS. 3 and 6 is a spray adjustor such as a nozzle plug 35 for adjusting pressure and area of a water jet emerging from the outlet orifice 8. Other types of spray adjustors are foreseeable. This one is similar in principle to some conventional garden-hose spray nozzles or water pressure cleaner systems which utilize fan or rotary spray nozzles. It adjusts water blast between a high-pressure spray 36 over a broad area and a coarse-flow spray 37 over a smaller area within the cleaning enclosure 1. The variable area of water spray provided by nozzle plug 35 works independently of the force valve 21 which adjusts the suction force in the open interior volume of the cleaning enclosure 1 against the intended surface to be cleaned 4.

In operation the low pressure water source line for the pump 9 may be connected to a standard sink faucet. The drain hose 20 from the wet vacuum is then attached to a suitable drain, even outside the building, so that when the device is turned on a submergible pump within the wet vacuum unit 11 will drain wastewater from the wet vacuum unit 11. Before starting the device, electrical lines 17 and 18 are plugged into the proper 110 electrical connections and the low pressure supply water through line 19 is turned on to provide water to the high pressure pump 9. The high pressure pump 9 is then turned on, as well as the vacuum pump 11, to start the cleaning process. The valve 24 on the vacuum tube assembly handle provides a means to turn high pressure water passing through the tube 12 on and off during the cleaning process. Once high pressure water is exiting the nozzle 7 within the cleaning enclosure 1, the only remaining adjustment is to set the proper balance between the vacuum or suction within the bottom portion 2 of the head assembly 1 and the ease of movement across the intended surface to be cleaned 4. The latter is accomplished preferably through the air control valve 21, which is initially set in the closed position. The valve 21 is manually opened allowing ambient air to enter the bottom portion 2 of the head assembly 1, resulting in less vacuum pressure being exerted against the surface 4, making it easier to move the contact gasket 14 across the surface 4. As wastewater is vacuumed and transported to the tank 11, the submergible pump within the tank 11 transports the wastewater to an external drain through line 20. The operation is continued until the surface is cleaned. Different surfaces may require a different balance of vacuum pressure which can be adjusted by opening or closing the manual valve 21 as necessary.

A new and useful grout- and hard-surface cleaning apparatus having been described, all such modifications, adaptations, substitutions of equivalents, combinations of parts, pluralities of parts, applications and forms thereof as described by the following claims are included in this invention.

Having thus described my invention, I claim:

1. A grout- and hard-surface cleaner comprising:

a cleaning enclosure having a perimeter with a surface-covering bottom portion and an open interior volume having a vacuum-suction top portion;

a water-blast nozzle positioned on the cleaning enclosure;

the water-blast nozzle having an inlet means positioned externally from an outside periphery of the cleaning enclosure and having an outlet orifice positioned internally of said open interior volume of the cleaning enclosure;

the outlet orifice having an outlet axis with an angular relationship and a distance relationship to an intended surface;

a water-supply source having high supply pressure in combination with a water-supply outlet with a low cross-sectional area to provide a water-supply force;

a high-pressure tube in fluid communication with a water-supply source and the inlet means for the water-blast nozzle;

a surface seal having sealing capacity between a bottom edge of the perimeter of the cleaning enclosure and the intended surface;

a wet vacuum to provide a maximum suction pressure to a volume defined by the cleaning enclosure;

an air control valve in an air control orifice which controllably and directly communicates the open interior volume of the cleaning enclosure with a surrounding ambience; and a vacuum tube in fluid communication intermediate the wet vacuum and the vacuum-suction top portion of the open interior volume of the cleaning enclosure.

2. A grout- and hard-surface cleaner as described in claim 1 wherein:

the control valve is a hand-operative valve having hand-operative control of rate of flow of air from outside to inside of the cleaning enclosure.

3. A grout- and hard-surface cleaner as described in claim 1 wherein:

the air control valve is an automatically pressure-operative valve having automatic control of rate of flow of air from outside to inside of the cleaning enclosure.

4. A grout- and hard-surface cleaner as described in claim 3 wherein:

the automatically pressure-operative valve has a means for hand-variable setting of opening pressure and opening distance.

5. A grout- and hard-surface cleaner as described in claim 3 wherein:

the automatically pressure-operative valve is a reed valve.

6. A grout- and hard-surface cleaner as described in claim 5 wherein:

the reed valve has a means for hand-variable setting of opening pressure and opening distance of the reed valve.

7. A grout- and hard-surface cleaner as described in claim 6 wherein:

the means for hand-variable setting of opening pressure and opening distance of the reed valve is a moveable restrainer in slidable contact with an opening side of a reed of the reed valve;

the moveable restrainer being slidable selectively intermediate a low-pressure setting proximate a fixed end of the reed and a high-pressure setting that is a design distance from the high-pressure setting towards an opening end of the reed;

the moveable restrainer being moveable in a direction towards the low-pressure setting to decrease opening pressure and to increase opening distance of the reed valve; and the moveable restrainer being moveable in a direction towards the high-pressure setting to increase opening pressure and to decrease opening distance of the reed valve.

8. A grout- and hard-surface cleaner as described in claim 1 wherein:

said water-supply source having selectively controllable pressure, and said wet vacuum having fixed suction pressure.

9. A grout- and hard-surface cleaner as described in claim 1 wherein:

said water-supply source having fixed pressure, and said wet vacuum having selectively variable suction pressure.

10. A grout- and hard-surface cleaner as described in claim 1 wherein:

said water-supply source having selectively variable pressure, and said wet vacuum having selectively variable suction pressure.

11. A grout- and hard-surface cleaner as described in claim 1 and further comprising:

a cleaner handle having a rigid tube forming a part of said vacuum tube extended from the vacuum-suction top portion of the cleaning enclosure at an angle and for a distance;

a flexible tube forming a part of said vacuum tube connected to the cleaner handle and the wet-vacuum; and said high-pressure tube attached to the cleaner handle and extended flexibly to the water-supply source.

12. A grout- and hard-surface cleaner as described in claim 11 wherein:

the wet vacuum and the water-supply source are joined together as a single cleaning-support unit.

13. A grout- and hard-surface cleaner as described in claim 12 wherein:

the single cleaning-support unit is mobile for following an operator where pulled by the vacuum tube and the water-supply tube in response to movement of the cleaner handle by the operator.

14. A grout- and hard-surface cleaner as described in claim 13 wherein:

the vacuum tube and water-supply tube are joined together throughout lengths thereof from the cleaner handle to the single cleaning-support unit.

15. A grout- and hard-surface cleaner as described in claim 1 wherein:

a water-blast-jet area and a water-blast-jet pressure of a water-blastjet emerging from the water-blast nozzle are adjustable by means of a spray adjustor on the water-blast nozzle, such that the water-blast jet can be adjusted for pressure and spray-blast contact of a selectively sized portion of area of the intended surface under the cleaning enclosure.

16. A grout- and hard-surface cleaner as described in claim 1 wherein:

the angular relationship of the outlet axis of the outlet orifice of the water-blast nozzle is vertical, such that pressurized water from the water-blast nozzle is directed with verticality against the intended surface.

17. A grout- and hard-surface cleaner as described in claim 16 wherein:

the cleaning enclosure is rectangular with four walls; and select walls are slanted inward from a large perimeter of the surface-covering bottom portion to a smaller perimeter of the vacuum-suction top portion of the cleaning enclosure.

18. A grout- and hard-surface cleaner as described in claim 17 wherein:

a front wall and two side walls of the cleaning enclosure are slanted inwardly at angles; and a rear wall of the cleaning enclosure is near verticality.

19. A grout- and hard-surface cleaner as described in claim 18 wherein:

the water-blast nozzle is attached to the front wall of the cleaning enclosure with the angular relationship of the outlet axis to the intended surface being verticality.

20. A grout- and hard-surface cleaner as described in claim 19 wherein:

the walls of the cleaning enclosure are transparent, such that cleaning action and thoroughness of cleaning can be viewed by an operator.

21. A grout- and hard-surface cleaner as described in claim 18 wherein:

the water-blast nozzle is attached to the rear wall of the cleaning enclosure with the angular relationship of the outlet axis to the intended surface being an acute, such that a jet of water blast from the water-blast nozzle strikes the intended surface at an acute angle.

22. A grout- and hard-surface cleaner as described in claim 21 wherein:

the walls of the cleaning enclosure are transparent, such that cleaning action and thoroughness of cleaning can be viewed by an operator.

23. A grout- and hard-surface cleaner as described in claim 1 wherein:

the water-blast nozzle is attached to a front portion of the cleaning enclosure with the angular relationship of the outlet axis to the intended surface being verticality.

24. A grout- and hard-surface cleaner as described in claim 23 wherein:

walls of the cleaning enclosure are transparent, such that cleaning action and thoroughness of cleaning can be viewed by an operator.

25. A grout- and hard-surface cleaner as described in claim 1 wherein:

the water-blast nozzle is attached to a rear portion of the cleaning enclosure with the angular relationship of the outlet axis to the intended surface being acute, such that a jet of water blast from the water-blast nozzle strikes the intended surface at an acute angle.

26. A grout- and hard-surface cleaner as described in claim 25 wherein:

the cleaning enclosure is transparent, such that cleaning action and thoroughness of cleaning can be viewed by an operator.

27. A grout- and hard-surface cleaner as described in claim 1 and further comprising:

cleaner wheels having axles attached to the cleaning enclosure, such that the cleaning enclosure is adjusted and maintained at a distance vertically above the intended surface, which also aids in facilitated motion during cleaner operation.

28. A grout- and hard-surface cleaner as described in claim 1 wherein:

the surface seal is resiliently rubberlike.

29. A grout- and hard-surface cleaner comprising:

a cleaning enclosure having a perimeter with a surface-covering bottom portion and an open interior volume having a vacuum-suction top portion;

a water-blast nozzle positioned on the cleaning enclosure;

the water-blast nozzle having an inlet means positioned externally from an outside periphery of the cleaning enclosure and having an outlet orifice positioned internally of said open interior volume of the cleaning enclosure;

the outlet orifice having an outlet axis with an angular relationship and a distance relationship to an intended surface;

a water-supply source having high supply pressure in combination with a water-supply outlet with a small cross-sectional area to provide a water-supply force;

a high-pressure tube connecting the water-supply source to the inlet means for the water-blast nozzle;

a surface seal having sealing capacity connected to a bottom edge of the perimeter of the cleaning enclosure and in contact with the intended surface;

a wet vacuum to provide a maximum suction force to a volume defined by the cleaning enclosure;

a means for adjusting and maintaining the suction pressure in desired proportion to ease of movement of the cleaning enclosure across the surface being cleaned;

the means for adjusting and maintaining the suction pressure in desired proportion to ease of movement of the cleaning enclosure being an air control valve in a force-control orifice which controllably and directly communicates the open interior volume of the cleaning enclosure with a surrounding ambience;

a cleaner handle having a rigid vacuum tube extended from the vacuum-suction top portion of the open interior volume of the cleaning enclosure at an angle and for a distance;

a flexible vacuum tube connected to the cleaner handle and the wet-vacuum;

a water-supply tube attached to the cleaner handle and extended flexibly to the water-supply source; and the wet vacuum and the water-supply source are joined together as a single cleaning-support unit.

30. A grout- and hard-surface cleaner as described in claim 29 wherein:

the single cleaning-support unit is mobile for following an operator where pulled by the flexible vacuum tube and the water-supply tube in response to movement of the cleaner handle by the operator.

31. A grout- and hard-surface cleaner as described in claim 29 wherein:

the angular relationship of the outlet axis of the outlet orifice of the water-blast nozzle is vertical, such that pressurized water from the water-blast nozzle is directed vertically against the intended surface.

32. A grout- and hard-surface cleaner as described in claim 29 wherein:

a water-blast-jet area and a water-blast-jet pressure of a water-blast jet emerging from the water-blast nozzle are adjustable by means of a spray adjustor on the water-blast nozzle, such that the water-blast jet can be adjusted for spray-blast contact of a selectively sized portion of area of the intended surface under the cleaning enclosure.

33. A grout- and hard-surface cleaner as described in claim 29 wherein:

the cleaning enclosure is rectangular with four walls;

select walls are slanted inward from a large perimeter of the surface-covering bottom portion to a smaller perimeter of the vacuum-suction top portion of the cleaning enclosure;

a front wall and two side walls of the cleaning enclosure are slanted inwardly at an angle; and a rear wall of the cleaning enclosure is near verticality.

34. A grout- and hard-surface cleaner as described in claim 33 wherein:

the water-blast nozzle is attached to the front wall of the cleaning enclosure with the angular relationship of the outlet axis to the intended surface being verticality.

35. A grout- and hard-surface cleaner as described in claim 34 wherein:

the walls of the cleaning enclosure are transparent, such that cleaning action and thoroughness of cleaning can be viewed by an operator.

36. A grout- and hard-surface cleaner as described in claim 33, wherein:

the water-blast nozzle is attached to the rear wall of the cleaning enclosure with the angular relationship of the outlet axis to the intended surface being acute, such that a jet of water blast from the water-blast nozzle strikes the intended surface at an acute angle; and the walls of the cleaning enclosure are transparent, such that cleaning action and thoroughness of cleaning can be viewed by an operator.

37. A grout- and hard-surface cleaner as described in claim 36 and further comprising:

cleaner wheels having axles attached to the cleaning enclosure, such that the cleaning enclosure is maintained at a distance vertically above the intended surface.

38. A grout- and hard-surface cleaner as described in claim 29 wherein:

the surface seal is resiliently rubberlike.

39. A grout- and hard-surface cleaner comprising:

a cleaning enclosure having a perimeter with a surface-covering bottom portion and an open interior volume having a vacuum-suction top portion;

a water-blast nozzle positioned on the cleaning enclosure;

the water-blast nozzle having an inlet means positioned externally of an outside periphery of the cleaning enclosure and having an outlet orifice positioned internally of said open interior volume of the cleaning enclosure;

the outlet orifice having an outlet axis with an angular relationship and a distance relationship to an intended surface;

a water-supply source having high supply pressure in combination with a water-supply outlet with a low cross-sectional area to provide a water-supply force;

a high-pressure tube connecting the water-supply source to the inlet means for the water-blast nozzle;

a surface seal having sealing capacity connected to a bottom edge of the perimeter of the cleaning enclosure and in contact with the intended surface;

a wet vacuum to provide a maximum suction force to a volume defined by the cleaning enclosure;

a vacuum tube in fluid communication with the wet vacuum and the vacuum-suction top portion of the open interior volume of the cleaning enclosure;

an air control valve in an air control orifice which controllably and directly communicates the open interior volume of the cleaning enclosure with a surrounding ambience; and cleaner wheels having axles attached to the cleaning enclosure, such that the cleaning enclosure is maintained at a distance vertically above the intended surface.

40. A grout- and hard-surface cleaner as described in claim 39 wherein:

a cleaner handle having a rigid tube forming a part of said vacuum tube extended from the vacuum-suction top portion of the cleaning enclosure at an angle and for a distance;

a flexible tube forming a part of said vacuum tube connecting the cleaner handle to the wet-vacuum; and the wet vacuum and the water-supply source are joined together as a single cleaning-support unit.

41. A grout- and hard-surface cleaner as described in claim 40 wherein:

the single cleaning-support unit is mobile for following an operator where pulled by the flexible tube and the said high-pressure tube in response to movement of the cleaner handle by the operator.

* * * * *